US008517342B2

(12) United States Patent
Dunca

(10) Patent No.: US 8,517,342 B2
(45) Date of Patent: Aug. 27, 2013

(54) DOOR LIFTING AND HOLDING TOOL

(76) Inventor: Adrian Dunca, Bel Air, MD (US)

( * ) Notice: Subject to any disclaimer, the term of this patent is extended or adjusted under 35 U.S.C. 154(b) by 323 days.

(21) Appl. No.: 13/093,052

(22) Filed: Apr. 25, 2011

(65) Prior Publication Data

US 2012/0267588 A1 Oct. 25, 2012

(51) Int. Cl.

| | |
|---|---|
| ***B66F 3/00*** | (2006.01) |
| ***B66F 3/24*** | (2006.01) |
| ***B66F 5/04*** | (2006.01) |
| ***E04G 21/14*** | (2006.01) |
| *B66F 15/00* | (2006.01) |

(52) U.S. Cl.
USPC ..... 254/131; 254/2 R; 414/10

(58) Field of Classification Search
USPC ..... 254/131, 2 R; 414/10, 11, 743
See application file for complete search history.

(56) References Cited

U.S. PATENT DOCUMENTS

| | | | | |
|---|---|---|---|---|
| 2,503,388 | A * | 4/1950 | Hedlund | 414/10 |
| 2,967,627 | A * | 1/1961 | Vinson | 254/2 R |
| 3,582,043 | A * | 6/1971 | Tranchero | 254/2 R |
| 3,861,662 | A * | 1/1975 | Morse | 269/17 |
| 3,923,167 | A * | 12/1975 | Blankenbeckler | 414/11 |
| 4,010,931 | A * | 3/1977 | Wheeler | 254/131 |
| 4,213,624 | A * | 7/1980 | Sanders | 280/43.12 |
| 4,278,244 | A * | 7/1981 | Carter | 269/17 |
| 4,810,151 | A * | 3/1989 | Shern | 414/11 |
| 4,978,132 | A * | 12/1990 | Wilson et al. | 280/47.131 |
| 5,318,316 | A * | 6/1994 | Shurtleff | 280/79.7 |
| 5,584,635 | A * | 12/1996 | Stapelmann | 414/11 |
| 5,814,842 | A | 9/1998 | Muldoon et al. | |
| 5,927,731 | A * | 7/1999 | Clarke | 280/79.7 |
| 5,975,826 | A * | 11/1999 | Scholder | 414/444 |
| 6,079,696 | A | 6/2000 | Bette | |
| 6,231,034 | B1 * | 5/2001 | Walker et al. | 269/17 |
| 6,264,184 | B1 * | 7/2001 | Armstrong et al. | 269/17 |
| 6,378,191 | B1 * | 4/2002 | County | 29/434 |
| 6,505,844 | B2 * | 1/2003 | Hallman et al. | 280/79.7 |
| 6,678,909 | B1 * | 1/2004 | Pyatt | 7/158 |
| 7,014,413 | B2 * | 3/2006 | Young | 414/743 |
| 7,780,389 | B1 * | 8/2010 | Young | 414/11 |
| 7,784,802 | B2 | 8/2010 | White | |
| 7,896,367 | B1 * | 3/2011 | Suprono | 280/47.15 |
| 8,002,510 | B2 * | 8/2011 | Williams | 414/10 |
| 8,100,419 | B2 * | 1/2012 | Morisset | 280/79.7 |
| 8,128,066 | B2 * | 3/2012 | Durrant | 254/131 |
| 8,220,780 | B2 * | 7/2012 | Guillore et al. | 254/131 |

* cited by examiner

*Primary Examiner* — Lee D Wilson
*Assistant Examiner* — Alvin Grant
(74) *Attorney, Agent, or Firm* — Larry J. Guffey

(57) ABSTRACT

For lifting, aligning and holding a side-hinged door during its installation into a door frame, an improved hand tool, of the type having an elongated base with proximal and distal ends, a fulcrum attached to the base near its distal end, and a pivoting lever, has the improvements of: (a) a vertical guide extending from the base proximate its proximal end, and (b) a movable lifting member having side portions that have a configuration which is adapted to align and cooperate with the vertical guides so as to limit the movement of the lifting member to only vertical motions, and with this lifting member having a front surface that that is configured to allow it to be easily placed beneath the bottom surface of a door and to support the door over a sufficient part of its width so as to minimize the chance of the lateral tilting of the door when it is being installed.

16 Claims, 7 Drawing Sheets

(a)

(b)

DOOR LIFTING AND HOLDING TOOL

BACKGROUND OF THE INVENTION

1. Field of the Invention

The present invention relates generally to implements for applying pushing or pulling forces. More particularly, the present invention relates to an improved hand tool for lifting, aligning and holding a side-hinged door during its installation into a door frame.

2. Description of the Related Art

Hand tools for lifting, holding and transporting doors or other elongated materials prior to and during their installation are well known. See, for example, U.S. Pat. Nos. 4,010,931, 5,814,841, 6,079,696, 6,378,191 and 7,784,802.

Most of these prior tools utilize a lever or support member that has a small surface area head that is placed underneath the bottom edge of the door. These have the disadvantage of allowing a door held in this manner to tilt laterally if the lever's head is not centered properly under the door. Furthermore, such tools generally do not provide any means for preventing the doors they lift from tiling either forward or backward during installation and therefore throwing off the vertical alignment that is needed during this installation process. Consequently, door installation is usually at least a two person job, with this second individual being tasked during the installation process with maneuvering the door to keep it in alignment.

An improved, hand tool for lifting, aligning and holding a door during its installation into a door frame is therefore needed—preferably one that will allow a single worker to perform such door installation tasks on a wide variety of side-hinged doors, from relatively lightweight residential doors to those weighing up to two hundred pounds or more for industrial applications. Furthermore, it would also be advantageous if such an improved hand tool could be constructed and sized in a manner that would allow it to be disassembled when not in use such that its components could be stored in a standard toolbox so that this tool would more likely be readily available on a worksite.

SUMMARY OF THE INVENTION

Recognizing the need for the development of an improved hand tool for lifting, aligning and holding a side-hinged door during its installation into a door frame, the present invention is generally directed to satisfying the needs set forth above and overcoming the problems and disadvantages exhibited by prior, door-lifting hand tools.

In accordance with a preferred embodiment of the present invention, an improved hand tool, for lifting, aligning and holding a side-hinged door during its installation into a door frame, that is of the type having a base, a fulcrum and a pivoting lever, has the improvements of: (a) a vertical guide extending from each side of this base's top surface, wherein this base is elongated with proximal and distal ends, and with the fulcrum attached to the base proximate its distal end and these vertical guides attached to the base proximate its proximal end, and (b) a movable lifting member having side portions that have a configuration which is adapted to align and cooperate with the vertical guides so as to limit the movement of the lifting member and door to only vertical motions above the base, and with this lifting member having a front portion or surface that is configured to allow this front surface to be easily placed beneath the bottom surface of a door and to support it over the sufficient width so as to minimize the chance of the lateral tilting of the door when it is being installed, and wherein the pivoting lever is elongated and has a configuration adapted to allow a portion of the lever's proximal end to contact the lifting member's bottom surface when a portion of this lever rests on the fulcrum with the lever's distal end extending beyond the fulcrum so that a downward force (i.e., by the foot of the tool's user) on the lever near its distal end causes an upward force on the lifting member at its contact point with the lever.

Thus, there has been summarized above (rather broadly and understanding that there are other preferred embodiments which have not been summarized above) the present invention in order that the detailed description that follows may be better understood and appreciated.

DESCRIPTION OF THE PREFERRED EMBODIMENT

Figure 1:
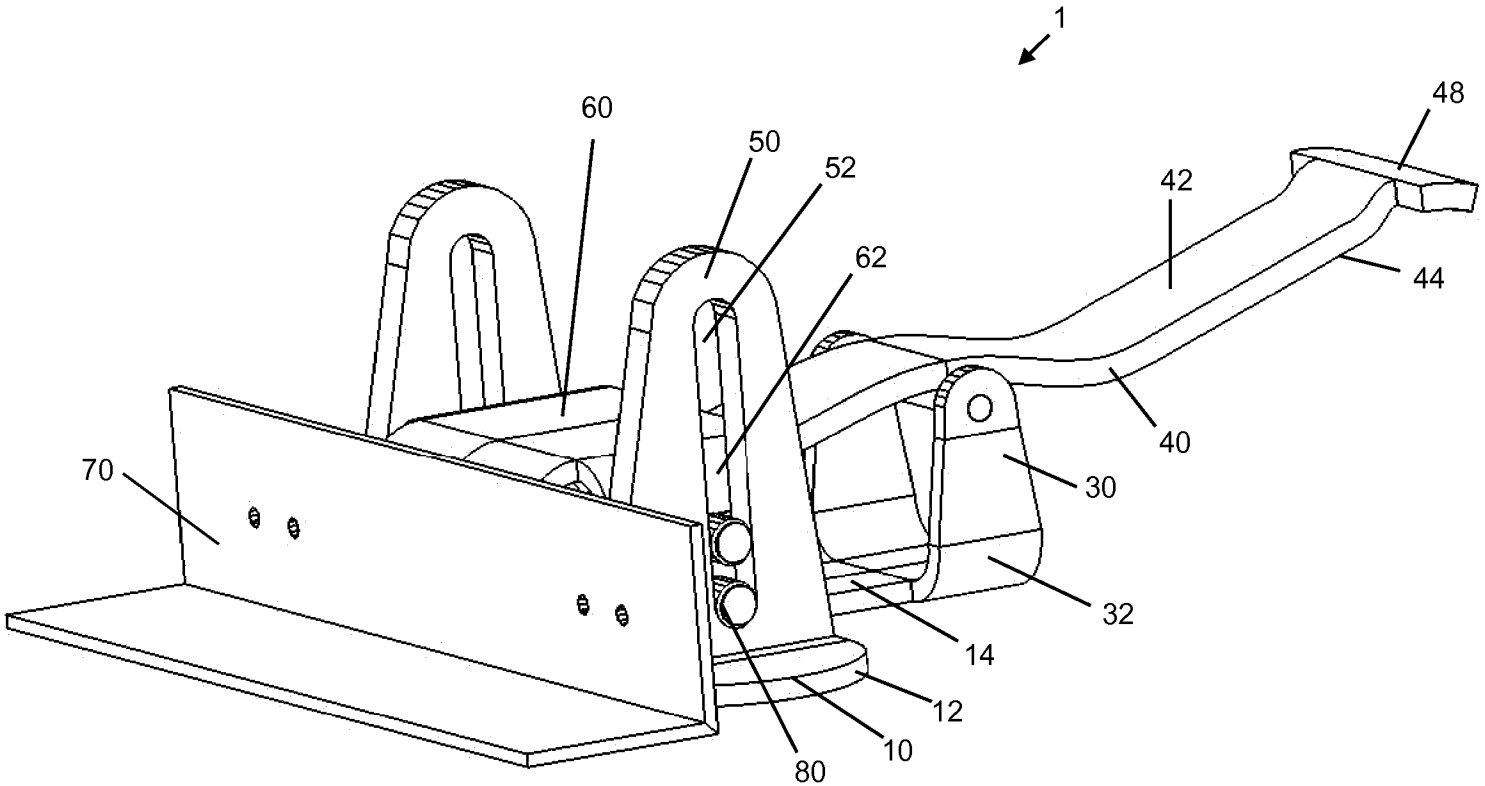
FIG. 1 is a perspective view of the present invention when its lifting member is in its movable lower position.
Figure 2:
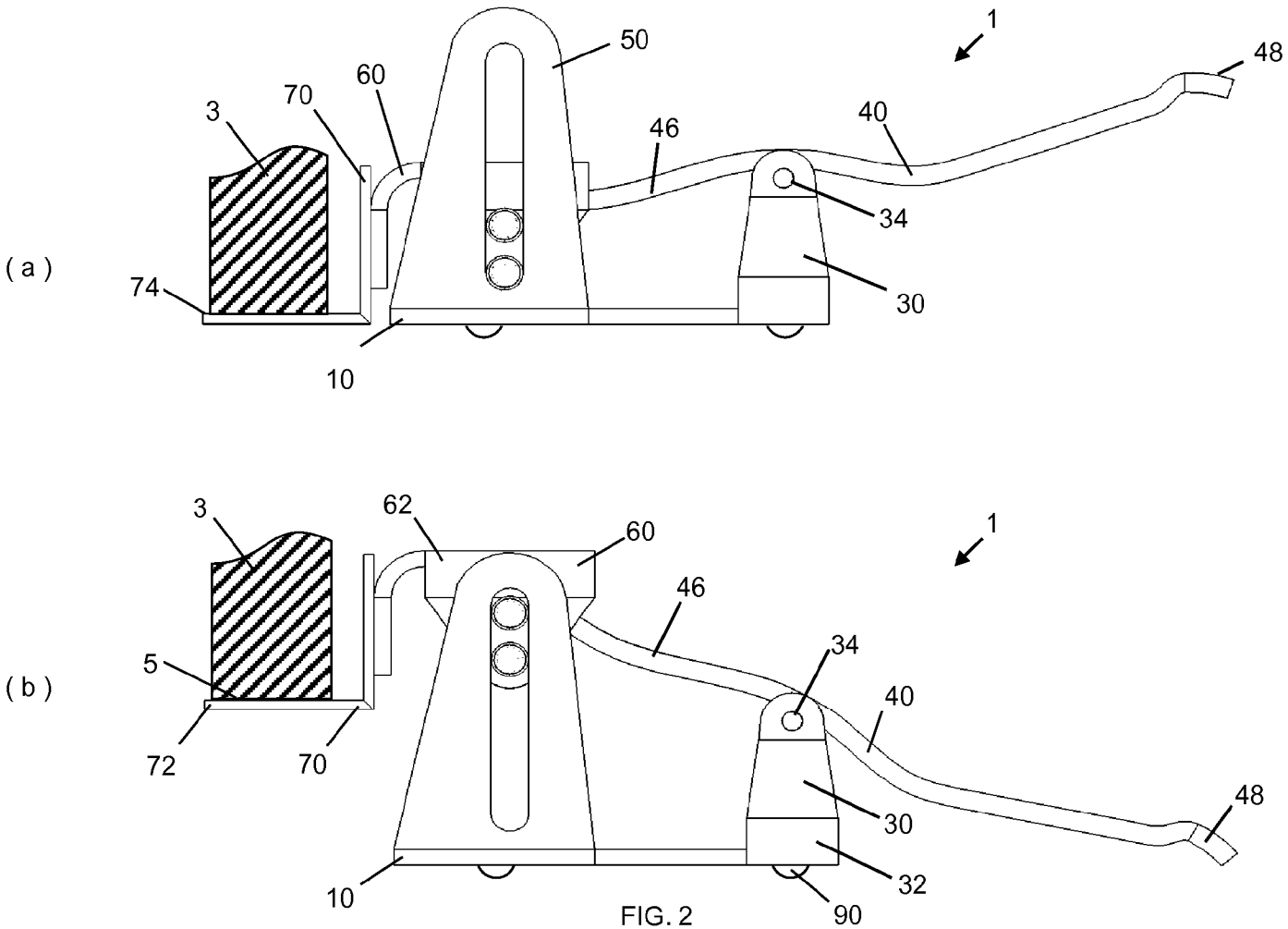
FIGS. 2(*a*) & 2(*b*) are side views of the present invention when its lifting member is in its down and up positions, respectively.
Figure 3:
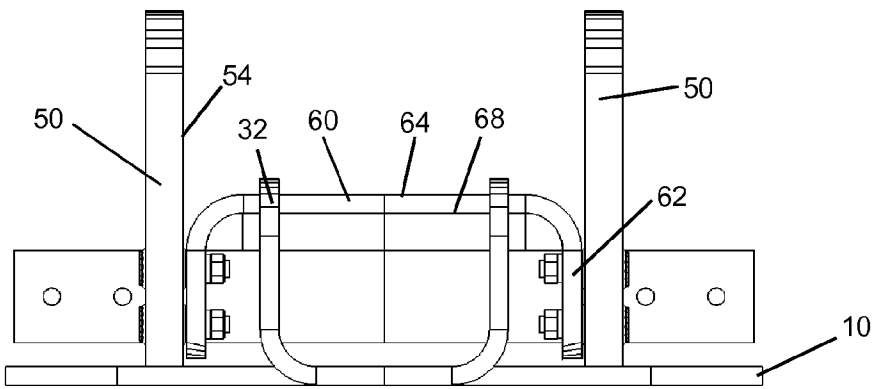
FIGS. 3(*a*) & 3(*b*) are, respectively, rear and side views of the present invention when its lever and the lifting member's front portion are not shown.
Figure 3:
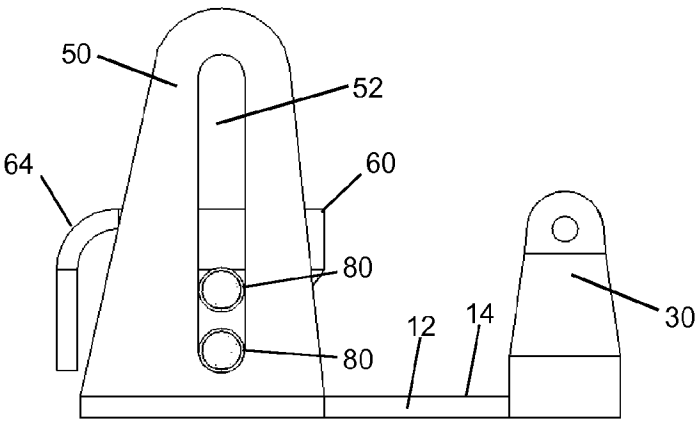

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

Referring to FIG. 1, there is illustrated a preferred embodiment of the present invention 1 in the form of an improved hand tool for lifting, aligning and holding a side-hinged door during its installation into a door frame. It is seen to have the somewhat expected parts or elements that include a base 10, a fulcrum 30 and a pivoting lever 40. However, it differs from the prior tools of this kind in that it has improvements that consist of: (a) a vertical guide 50 that extends from proximate each side 12 of this elongated base's top surface 14 and (b) a movable lifting member 60 whose sides or side portions 62 are configured to align and cooperate with the vertical guides 50 so as to limit the movement of the lifting member 60 to only vertical motions.

These restrictions on the lifting member's and door's motion prove to be a significant advantage over the capabilities of prior hand tools that have been used for this purpose, since it is often the forward and rearward tiling of a door during its installation that makes this installation process so difficult and manpower intensive.

Figure 5:
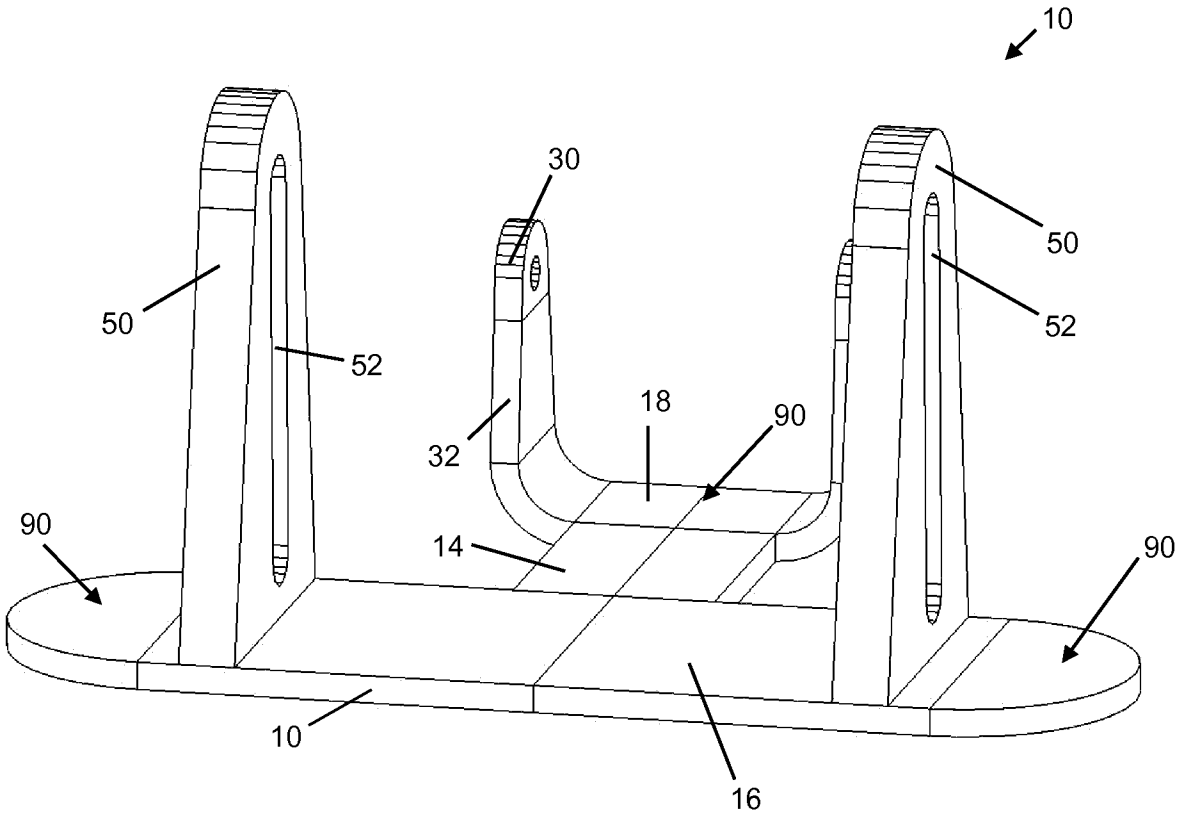
FIG. 5 is a perspective view of a first version of the base of the present invention.

The base 10 for the present invention, as shown in FIG. 5, has proximal 16 and distal 18 ends and the invention's fulcrum 30, that in this instance consists of a vertical projection 32 extending from proximate each side of the base 10, is attached to the base's top surface 14 proximate its distal 18 end. The pin or beam 34 connecting them at a specified distance above the base's top surface 14 is attached to the lever's bottom surface 44.

Figure 6:
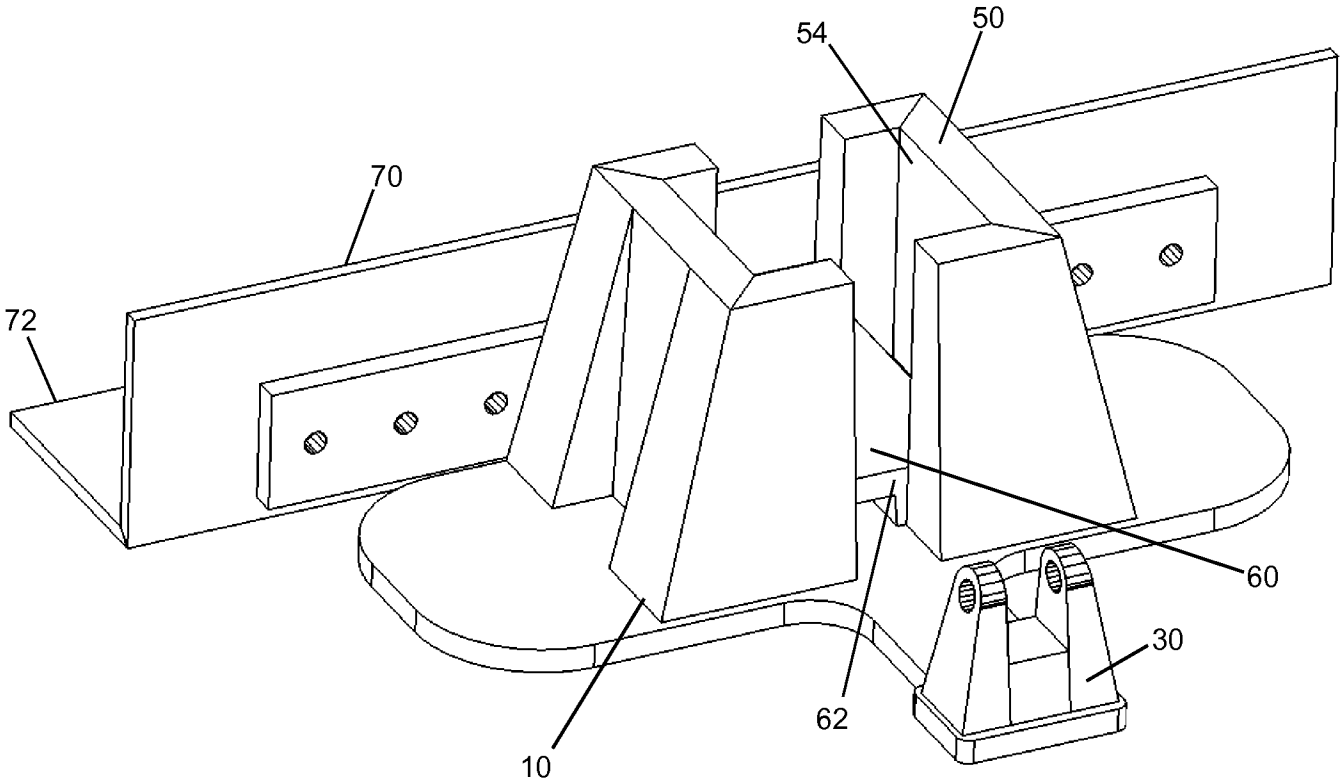
FIG. 6 is a perspective view of a second version of the base and the lifting member of the present invention.

FIGS. 1-3 and 5 show a first version of the vertical guides 50 that extend from this base. Each of these guides has a slot 52 that serves to restrict and define the direction of motion which can be created by the sleeve bearings 80 which are used with this version and fitted into each of these slots. Meanwhile, a second version of these guides is shown in FIG. 6 where they are seen to consist of a pair of channel-shaped members 50, each of which extends vertically from proximate a side of the base's top surface. For such members, it is their inner surfaces 54 which are configured to restrict and define the direction of motion which can be created by the sides 62 of the rear portion 64 of the lifting member 60 which is fitted between these channel-shaped members 50.

Figure 4:
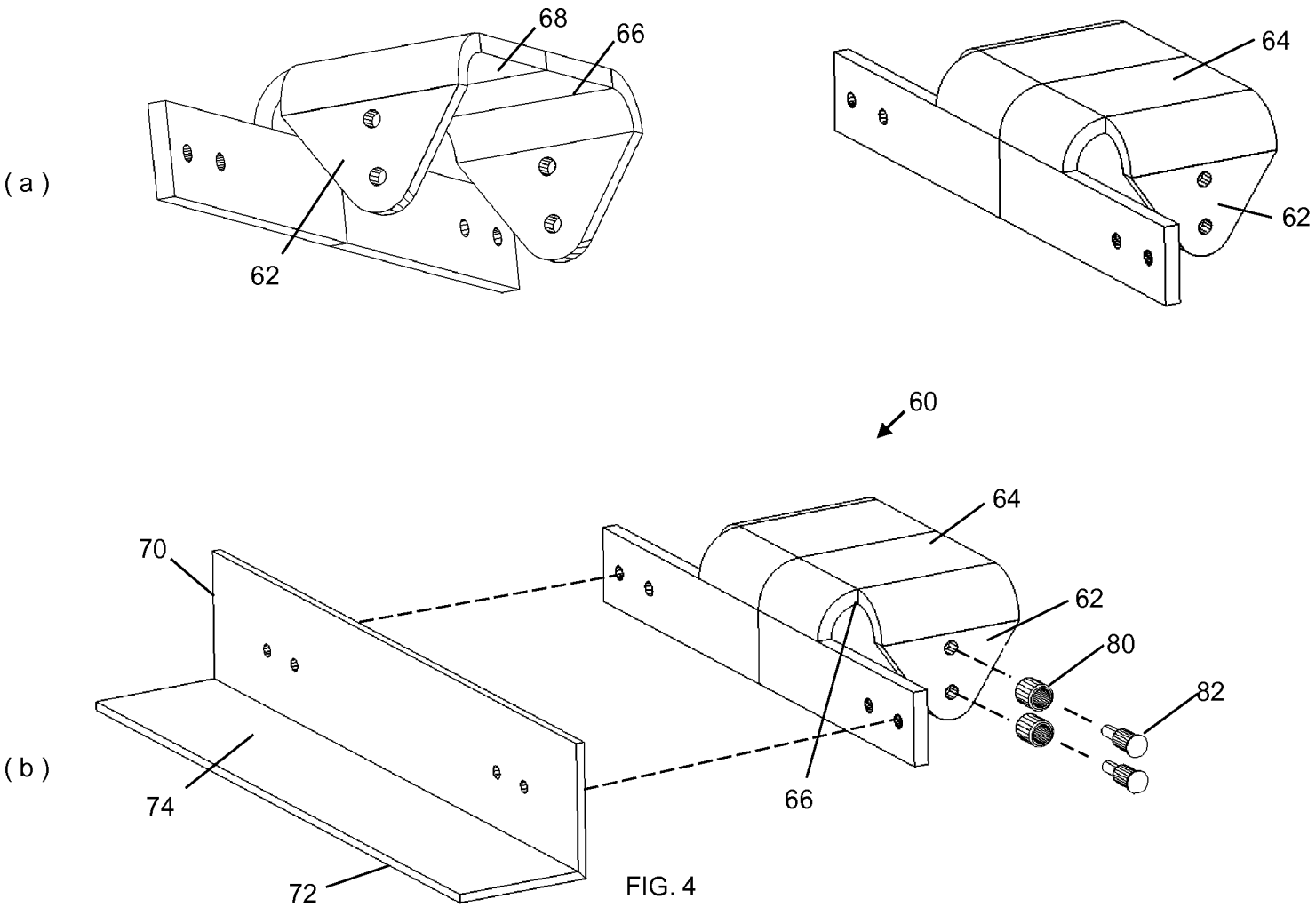
FIGS. 4(*a*) & 4(*b*) are, respectively, perspective views of the rear portion of lifting member of the present invention and the lifting member when its front portion has been detached and moved forward.

A first version of the movable lifting member 60 of the present invention is shown in FIGS. 4(*a*)-4(*b*). It consists of a rear portion 64 that has vertical sides or side surfaces 62 that extend downward from the side edges 66 of the bottom surface 68 of this rear portion. Two, vertically-aligned sleeve bearings 80 are seen to be affixed to each of these sides 62 by the use of shoulder bolts 82.

This member's front portion 70 consists of a front edge 72 which has a configuration adapted to allow at least a portion of a door's bottom surface 5 to stably sit on its top surface 74 (i.e., the front edge is sufficient wide with respect to the door's width so as to minimize the chance of the lateral tilting of the door when it is being moved) while also having a thickness at its leading edge that allows it to be easily placed under a door 3 and then used to lift and align the door. This front portion is detachably attached to the front of the rear portion. See FIG. 4. Additionally, a selection of front portions of differing widths may be provided so that a user of this tool can have available a front portion that is ideally suited to the width of the door that is to be installed.

The lifting member's front portion 70 is also configured so that it can be detached from the member's rear portion 64 so as to reduce the overall width of the hand tool during its transport so that its components can more easily be placed within and transported by a tool box.

Figure 7:
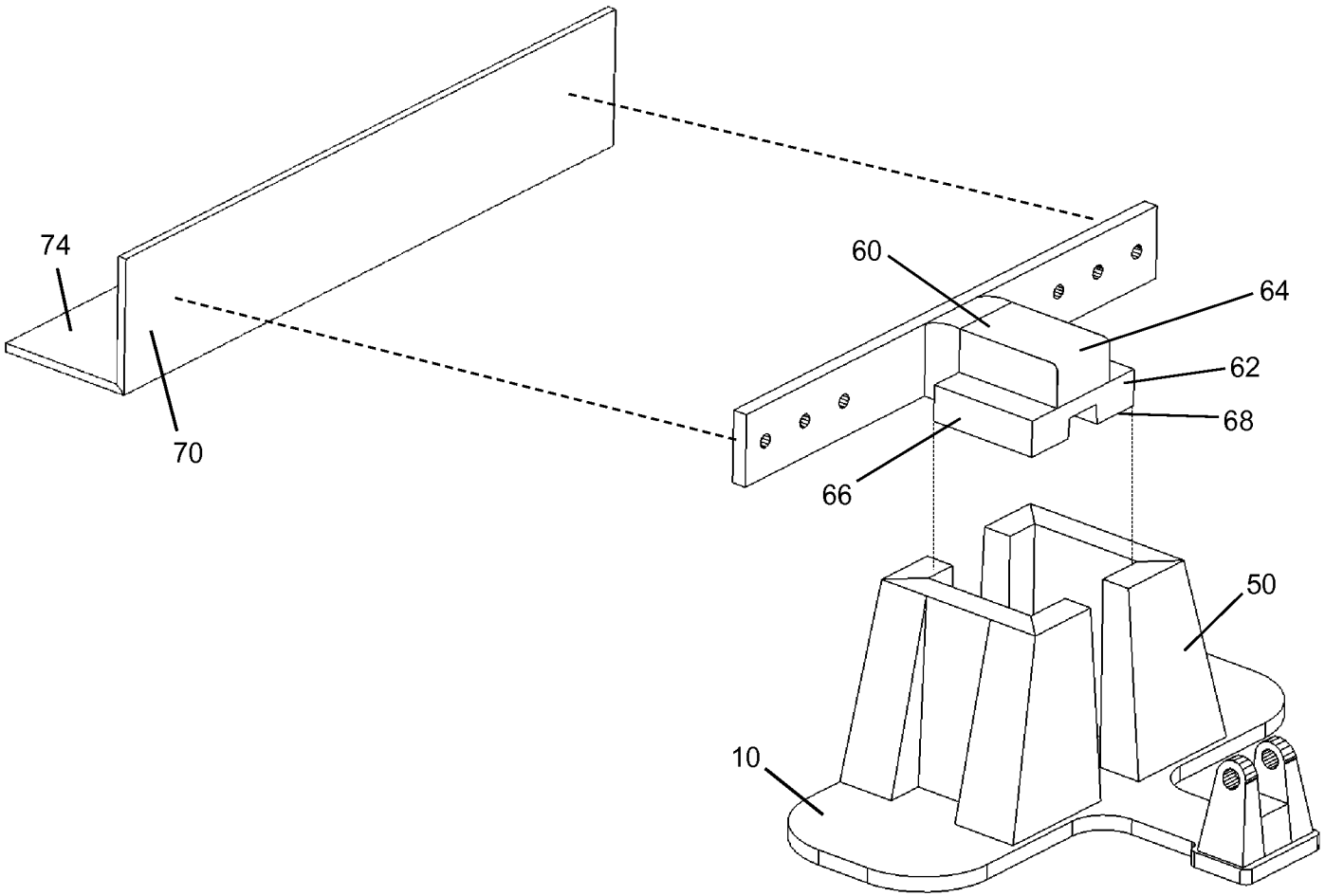
FIG. 7 is an exploded view of the base and lifting member shown in FIG. 6.

A second version of the movable lifting member 60 of the present invention is shown in FIG. 7. Its rear portion 64 has vertical sides or side surfaces 62 that are configured to fit within this version's channel-shaped members or guides 50 which are seen to restrict these sides 62 to move only vertically.

The design of this second version is thought to be more appropriate when the base, fulcrum, vertical guides and lifting member of the present invention are to be made from plastics, rather than from metal, which is the alternative material of construction for these components and the primary material of construction for the present invention's lever.

The pivoting lever 40 of the present invention is elongated and has top 42 and bottom 44 surfaces and proximal 46 and distal 48 ends. It has a configuration that allows a portion of the lever's top surface proximate its proximal end 46 to contact the bottom surface 68 of the lifting member's rear portion when the lever rests on the fulcrum and its distal 48 end extends beyond the fulcrum so that a downward force on the lever near its distal end, as applied by a door installer's foot, causes an upward force to be exerted on the rear portion of the lifting member's bottom surface at the point where the lever's proximal end 46 contacts the lifting member.

To increase the mobility of the base 10, casters 90 can be added beneath its bottom surface or affixed to the base that will allow it to be easily moved and positioned over an underlying floor so that its lifting member's front edge can be properly positioned to lift the bottom edge of a door that is to be installed. The use of these casters has the further advantage of minimizing the chances that the underlying floor could be damaged as the door is maneuvered for installation.

The foregoing is considered as illustrative only of the principles of the invention. Further, since numerous modifications and changes will readily occur to those skilled in the art, it is not desired to limit the invention to the exact construction and operation shown and described herein. Accordingly, all suitable modifications and equivalents may be resorted to, falling within the scope of the invention that is hereinafter set forth in the claims to the invention.

I claim:

1. An improved hand tool, of the type having an elongated base with proximal and distal ends and top and side surfaces, a fulcrum attached to said base proximate the distal end of said base, and an elongated pivoting lever with proximal and distal ends, said hand tool to be placed on an underlying floor and used for lifting, aligning and holding a side-hinged door along the bottom edge during installation of said door into a door frame, wherein the improvements comprising:

a vertical guide extending from said base, a movable lifting member having front and rear portions, said rear portion having a bottom surface and a configuration which is adapted to allow said rear portion to cooperate with said vertical guides so as to limit the movement of said lifting member and said door with respect to said base to only vertical motions, said front portion having a configuration which is adapted to allow said front portion to lift said door along said door bottom edge and support said door over a sufficient portion of the width of said door so as to minimize the chance of the lateral tilting of said door during said installation, and wherein said pivoting lever having a configuration adapted to allow said proximal end of said lever to contact said bottom surface of said lifting member when a portion of said lever rests on said fulcrum and with said distal end of said lever extending beyond said fulcrum.

2. The improved hand tool as recited in claim 1, further comprising:

a plurality of casters attached to said base to allow for the movement of said base over an underlying floor.

3. The improved hand tool as recited in claim 1, wherein:

said lifting member front portion having a configuration that allows said front portion to be detached from said lifting member rear portion so that said hand tool can more easily be placed within and transported by a tool box.

4. The improved hand tool as recited in claim 2, wherein:

said lifting member front portion having a configuration that allows said front portion to be detached from said lifting member rear portion so that said hand tool can more easily be placed within and transported by a tool box.

5. The improved hand tool as recited in claim 1, wherein:

said lifting member front portion is a plurality of lifting member front portions with each having a differing width that is within a specific range of widths, and wherein said specific range of widths is chosen in consideration of the range of the widths of the doors that it is desired to install with said tool and said requirement that said lifting member front portion support said door over a sufficient portion of the width of said door so as to minimize the chance of the lateral tilting of said door during said installation.

6. The improved hand tool as recited in claim 2, wherein:

said lifting member front portion is a plurality of lifting member front portions with each having a differing width that is within a specific range of widths, and wherein said specific range of widths is chosen in consideration of the range of the widths of the doors that it is desired to install with said tool and said requirement that said lifting member front portion support said door over a sufficient portion of the width of said door so as to minimize the chance of the lateral tilting of said door during said installation.

7. The improved hand tool as recited in claim 3, wherein:

said lifting member front portion is a plurality of lifting member front portions with each having a differing width that is within a specific range of widths, and wherein said specific range of widths is chosen in consideration of the range of the widths of the doors that it is desired to install with said tool and said requirement that said lifting member front portion support said door over a sufficient portion of the width of said door so as to minimize the chance of the lateral tilting of said door during said installation.

8. The improved hand tool as recited in claim 4, wherein:

said lifting member front portion is a plurality of lifting member front portions with each having a differing width that is within a specific range of widths, and wherein said specific range of widths is chosen in consideration of the range of the widths of the doors that it is desired to install with said tool and said requirement that said lifting member front portion support said door over a sufficient portion of the width of said door so as to minimize the chance of the lateral tilting of said door during said installation.

9. A hand tool which is to be placed on an underlying floor and used for lifting, aligning and holding a side-hinged door along the bottom edge during installation of said door into a door frame, said hand tool comprising:

an elongated base with proximal and distal ends and top and side surfaces, a fulcrum attached to said base proximate the distal end of said base, an elongated pivoting lever with proximal and distal ends, a vertical guide extending from said base, a movable lifting member having front and rear portions, said rear portion having a bottom surface and a configuration which is adapted to allow said rear portion to cooperate with said vertical guides so as to limit the movement of said lifting member and said door with respect to said base to vertical motions, said front portion having a configuration which is adapted to allow said front portion to lift said door along said door bottom edge and support said door over a sufficient portion of the width of said door so as to minimize the chance of the lateral tilting of said door during said installation, and wherein said pivoting lever having a configuration adapted to allow said proximal end of said lever to contact said bottom surface of said lifting member when a portion of said lever rests on said fulcrum and with said distal end of said lever extending beyond said fulcrum.

10. The hand tool as recited in claim 9, further comprising:

a plurality of casters attached to said base to allow for the movement of said base over an underlying floor.

11. The hand tool as recited in claim 9, wherein:

said lifting member front portion having a configuration that allows said front portion to be detached from said lifting member rear portion so that said hand tool can more easily be placed within and transported by a tool box.

12. The hand tool as recited in claim 10, wherein:

said lifting member front portion having a configuration that allows said front portion to be detached from said lifting member rear portion so that said hand tool can more easily be placed within and transported by a tool box.

13. The hand tool as recited in claim 9, wherein:

said lifting member front portion is a plurality of lifting member front portions with each having a differing width that is within a specific range of widths, and wherein said specific range of widths is chosen in consideration of the range of the widths of the doors that it is desired to install with said tool and said requirement that said lifting member front portion support said door over a sufficient portion of the width of said door so as to minimize the chance of the lateral tilting of said door during said installation.

14. The hand tool as recited in claim 10, wherein:

said lifting member front portion is a plurality of lifting member front portions with each having a differing width that is within a specific range of widths, and wherein said specific range of widths is chosen in consideration of the range of the widths of the doors that it is desired to install with said tool and said requirement that said lifting member front portion support said door over a sufficient portion of the width of said door so as to minimize the chance of the lateral tilting of said door during said installation.

15. The hand tool as recited in claim 11, wherein:

said lifting member front portion is a plurality of lifting member front portions with each having a differing width that is within a specific range of widths, and wherein said specific range of widths is chosen in consideration of the range of the widths of the doors that it is desired to install with said tool and said requirement that said lifting member front portion support said door over a sufficient portion of the width of said door so as to minimize the chance of the lateral tilting of said door during said installation.

16. The hand tool as recited in claim 12, wherein:

said lifting member front portion is a plurality of lifting member front portions with each having a differing width that is within a specific range of widths, and wherein said specific range of widths is chosen in consideration of the range of the widths of the doors that it is desired to install with said tool and said requirement that said lifting member front portion support said door over a sufficient portion of the width of said door so as to minimize the chance of the lateral tilting of said door during said installation.

* * * * *